US005357910A

United States Patent [19]

Wenger et al.

[11] Patent Number: 5,357,910

[45] Date of Patent: Oct. 25, 1994

[54] CYLINDER BLOCK AND HEAD COOLING SYSTEM

[75] Inventors: Urs Wenger; Hans R. Jenni, both of Langenthal; Hans P. Goetti, Zetzwil, all of Switzerland

[73] Assignee: SMH Management Services AG, Biel, Switzerland

[21] Appl. No.: 970,714

[22] Filed: Nov. 2, 1992

[30] Foreign Application Priority Data

Oct. 31, 1991 [FR] France ..... 91 13606

[51] Int. Cl.[5] ..... F02B 75/18

[52] U.S. Cl. ..... 123/41.74; 123/41.82 R; 123/41.84

[58] Field of Search ..... 123/41.72, 41.74, 41.83, 123/41.84, 41.28, 41.82 R

[56] References Cited

U.S. PATENT DOCUMENTS

| | | | |
|---|---|---|---|
| 1,625,835 | 4/1927 | Sutton et al. | 123/195 R |
| 4,108,118 | 8/1978 | George | 123/41.57 |
| 4,284,037 | 8/1981 | Kasting et al. | 123/41.72 |
| 4,616,600 | 10/1986 | Hirano | 123/41.74 |

FOREIGN PATENT DOCUMENTS

| | | | |
|---|---|---|---|
| 356227 | 2/1990 | European Pat. Off. . | |
| 450067 | 10/1991 | European Pat. Off. . | |
| 2904167 | 8/1980 | Fed. Rep. of Germany | 123/41.82 R |
| 2323020 | 4/1977 | France . | |
| 2127487 | 4/1984 | United Kingdom | 123/41.72 |

*Primary Examiner*—Noah P. Kamen

*Attorney, Agent, or Firm*—Weil, Gotshal & Manges

[57] ABSTRACT

An internal combustion engine having an improved cooling circuit in which the liquid for cooling the cylinder block 1 and the cylinder head 2 circulates successively through an input orifice 16, the axis of which is perpendicular to the alignment of the cylinders, an annular chamber 34 formed by the cylinder liner 28, communication ducts 22–23 and 24–25, circulation channels 36 and an output orifice having a diameter less than that of the input orifice and located on the same face of the engine. Such engine, in a principal or auxiliary role, may be used to drive various types of appliances or other machines which preferably operate at constant operating conditions.

5 Claims, 12 Drawing Sheets

CYLINDER BLOCK AND HEAD COOLING SYSTEM

BACKGROUND OF THE INVENTION

The present invention relates generally to an internal combustion engine having an improved liquid cooling circuit which substantially improves the operating conditions of the engine, consequently reducing in a very significant manner the proportions of noxious products in the exhaust gases.

In order to increase the thermal efficiency and reduce the polluting nature of internal combustion engines, research has been directed both towards improving the internal operation of the engine and to treating the exhaust gases, mainly by thermal or catalytic after-burning. In order to obtain a sufficiently low level of noxious products, it is often necessary to call on both types of improvement within the same engine.

The present invention improves the circulation of cooling liquid within the engine. In order to optimize thermal efficiency, it is important to maintain an uniform operating temperature at all portions of the engine. In presently known engines, and more particularly in engines with cylinders arranged in line, the cooling liquid circulates parallel to the axis of the crankshaft and to the alignment of the cylinders, in the space located between the cylinders and the cylinder block as illustrated generally in FIGS. 1 and 2 of the drawings. Whatever may be the improvements which are effected (acceleration, increased pressure, composition of the cooling liquid, etc.), there always exists a temperature gradient between the input and the output of the cooling liquid. Thus the temperature in the combustion chamber of the first cylinder is different from that of the last cylinder. Furthermore, because the flow cross-section of the cooling liquid varies, turbulence is necessarily created between the cylinder block and the cylinders which generates hot spots, thereby spoiling optimum operation of the engine.

SUMMARY OF THE INVENTION

According to the invention, the above-cited difficulties are overcome by forming a cylinder block and its cylinder head such that the cooling liquid circulates perpendicularly to the alignment of the cylinders, with the input orifices and output orifices being located on the same face of the engine,—preferably on the admission side. The output orifices have a cross-section smaller than that of the input orifices in order to bring about a slight over-pressure, and cooling liquid circulates around the cylinders in an annular chamber having a uniform cross-section. A passage is provided for the cooling liquid from the cylinder block to the cylinder head by ducts between the cylinder block and the collar of the liner, such ducts on the cooling liquid input/output side of the engine having a smaller cross-section than those located on the opposite side.

The improvements according to the invention may be applied in all types of engines whatever be the system of operation, the number and arrangement of the cylinders, the cylindrical cubic capacity, or the fuel employed.

In order better to understand the invention and to bring forth more clearly other purposes, characteristics, details and advantages, the detailed description hereinafter concerns, by way of a non-limiting example, a 4-stroke engine having two cylinders in line with wet liners, of 250 cc and employing gasoline.

DESCRIPTION OF THE PREFERRED EMBODIMENT

In all the figures enumerated hereinabove, the portions shown with horizontal discontinuous hatching represent the cooling liquid and the unreferenced arrows represent the sense of circulation of said liquid. The cylinder block is designated generally by reference 1 and the cylinder head by reference 2. The other portions of the engine not directly concerning the invention (oil sump, oil filter, pistons, cranks, pulleys, etc.) are either not shown or not referenced.

Figure 1:
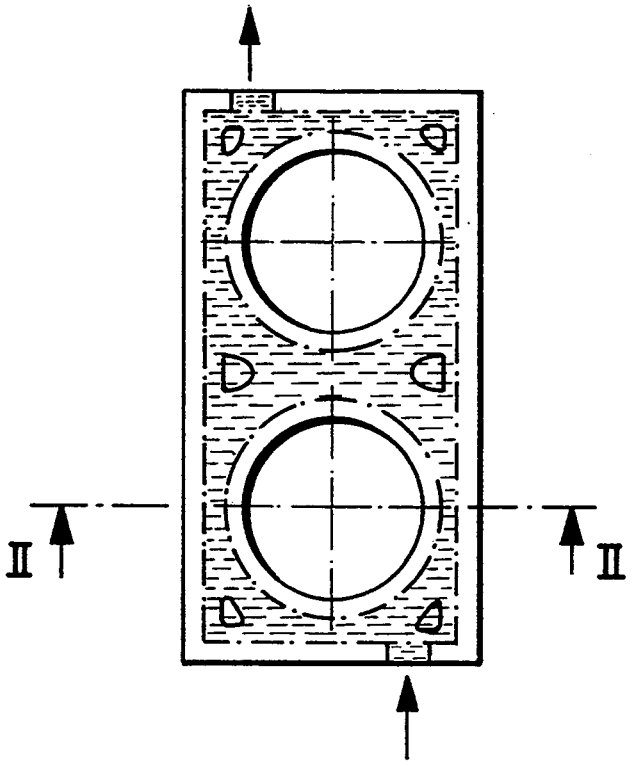
FIGS. 1 and 2 show schematically the cooling liquid circulation in a conventional engine.
Figure 2:
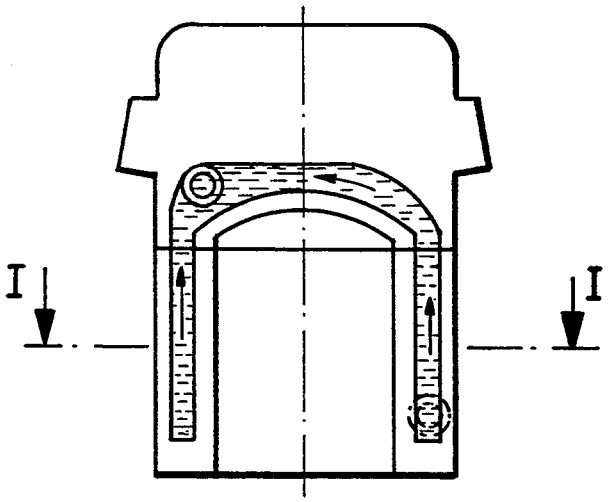
Figure 3:
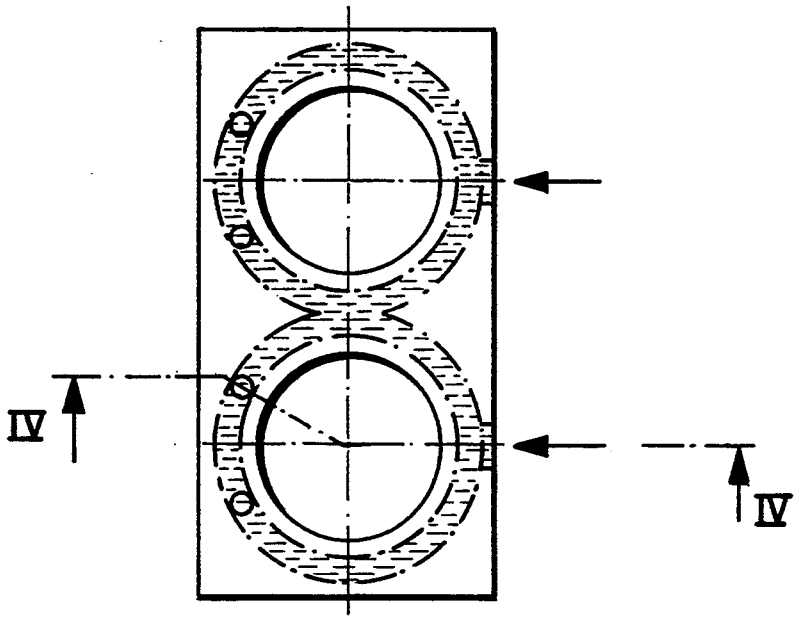
FIGS. 3 and 4 show the schematically the cooling liquid circulation in an engine according to the invention.
Figure 4:
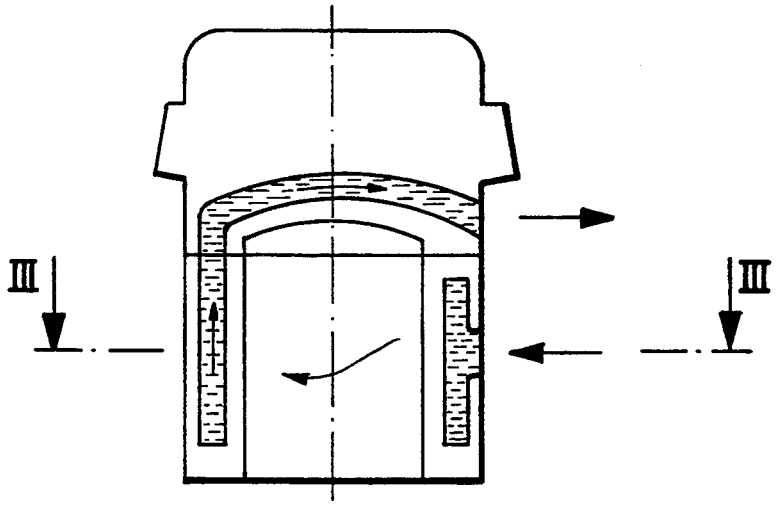
Figure 5:
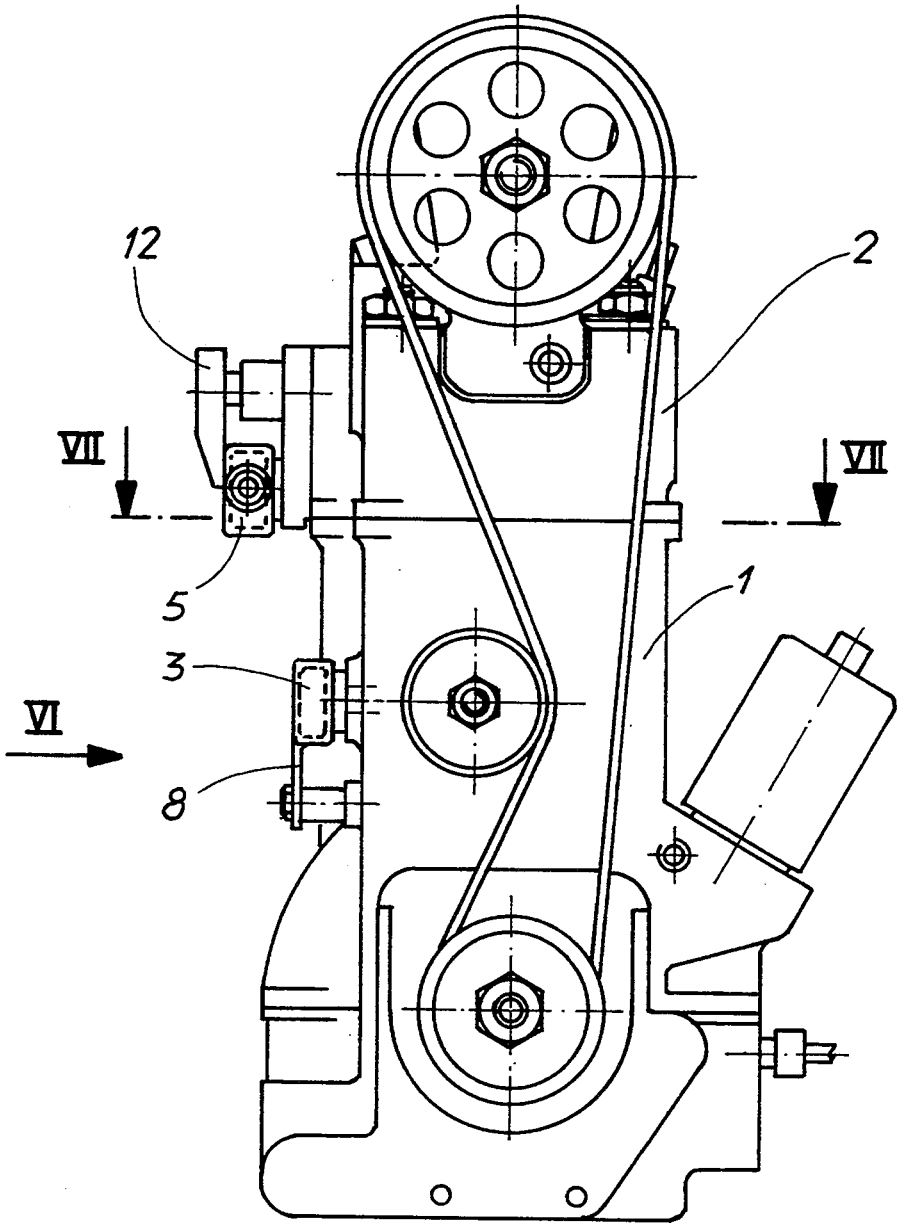
FIG. 5 shows a face view of the complete engine according to arrow V of FIG. 6.

Cylinder block 1 and cylinder head 2 in which the cooling liquid is circulated are positioned by assembling studs 26 led into holes 38 provided in cylinder head 1 and assembled by appropriate means such as fastening screws engaged in holes 20. On FIGS. 5 and 6 are shown the intake duct 3 and outlet duct 5 for the cooling liquid, said ducts being respectively secured by fastening lugs 8 and screws 9 to the cylinder block 1 and by a lug 12 and fastening screw 13 to the cylinder head; the arrows show the principal inlet 4 and the principal outlet 7 for the cooling liquid.

Figure 6:
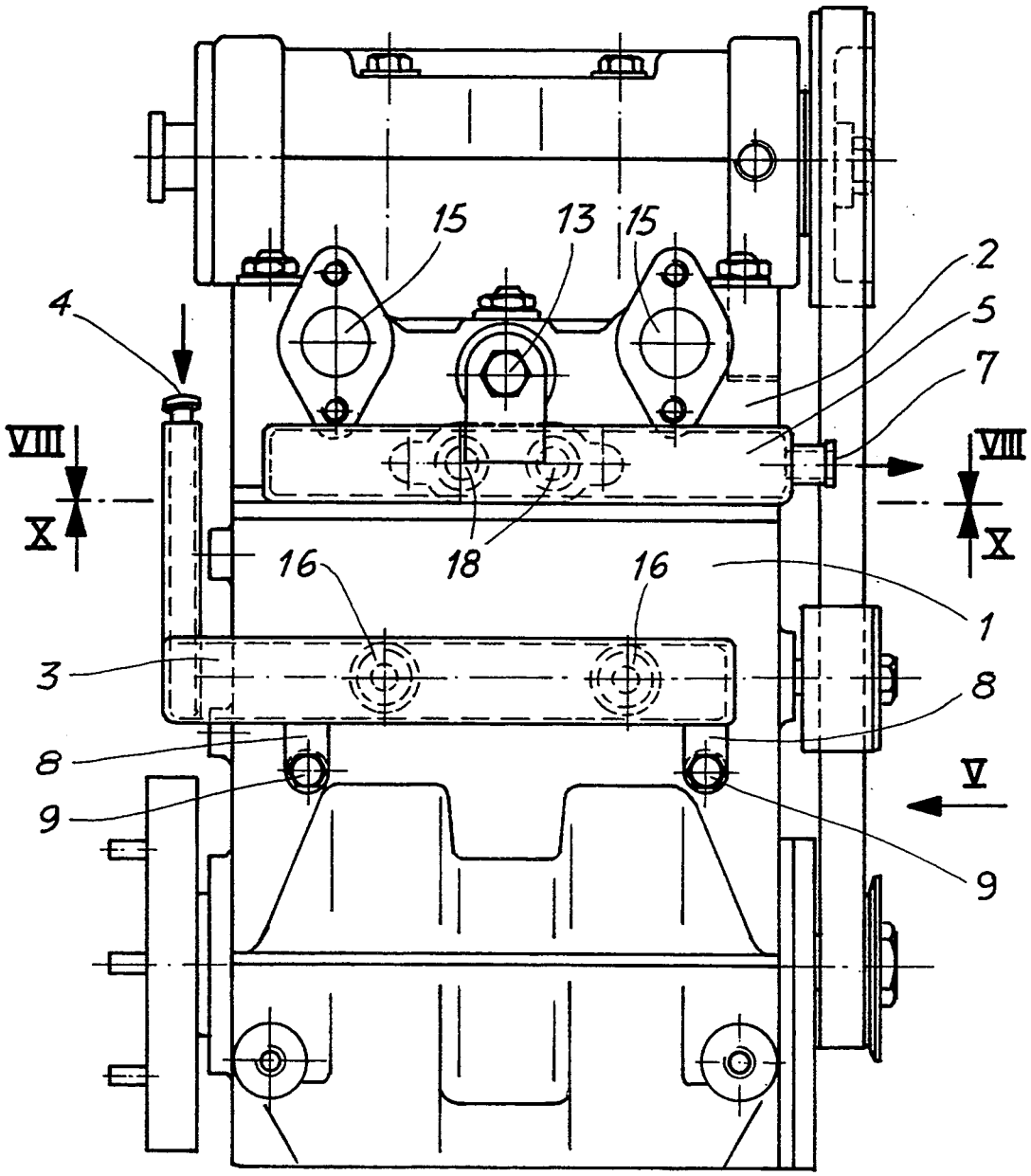
FIG. 6 shows a side view of the complete engine according to arrow VI of FIG. 5.

On FIG. 6 is also shown that ducts 3 and 5 are positioned on the same face of the motor as the admission orifices 15 for the fuel mixture. On FIG. 6 there has also been shown in dashed outlines the inlet orifices 16 and outlet orifices 18 for the cooling liquid; this shows in conformity with the schematic of the principle 4 that the outlet orifice has a diameter less than that of the inlet orifice.

Figure 7:
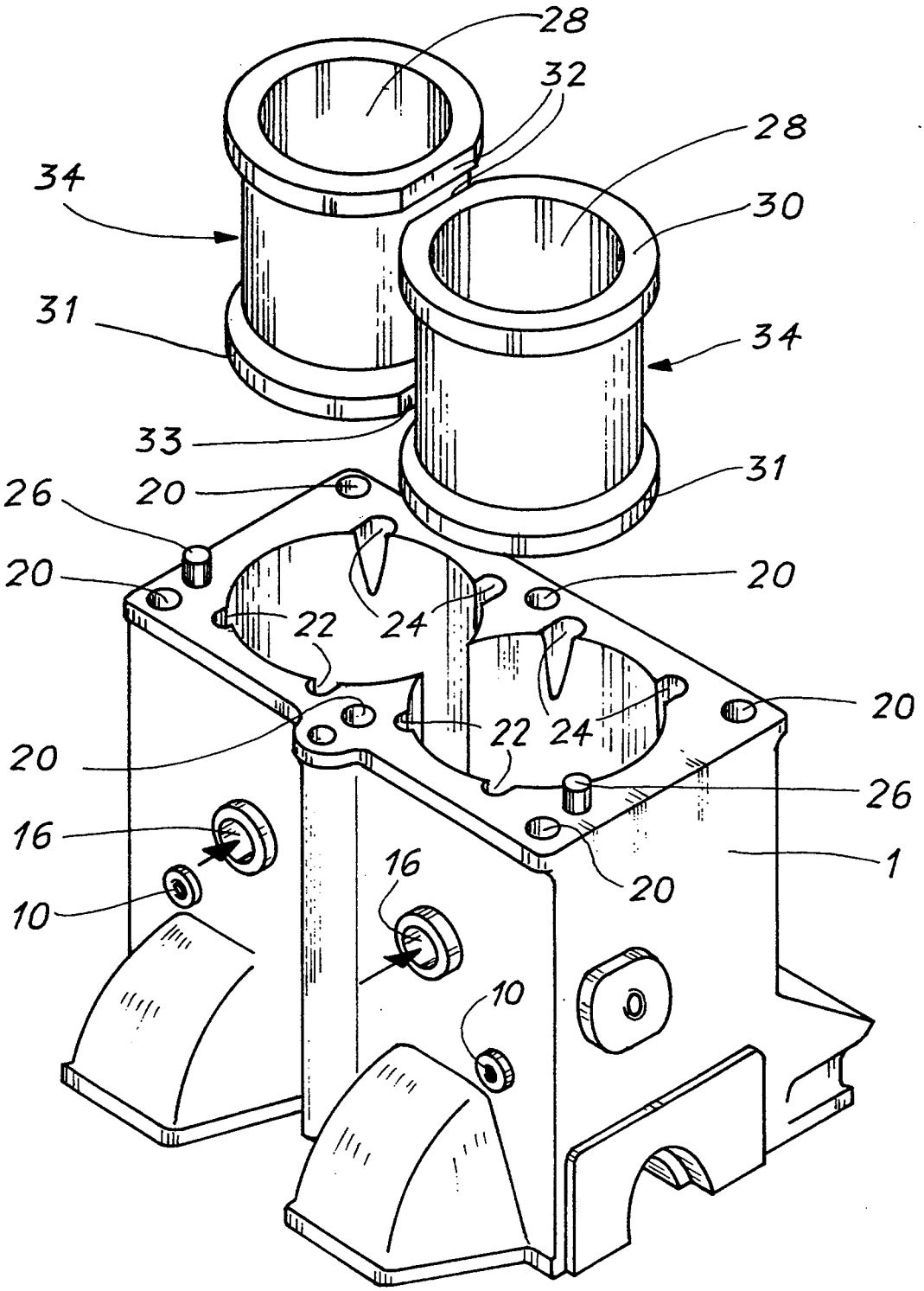
FIG. 7 shows an exploded schematic perspective view of the engine limited to the cylinder block and to the cylinder liners according to line VII—VII of FIG. 5.

FIG. 7, which shows an exploded perspective view, and the views and cross-sections of the figures following, are intended to assure better understanding of the method of circulation of the water according to the invention. Besides the elements already described, holes 10 serve to secure lugs 8. On the top surface of the cylinder block 1 in FIG. 7 appear communication ducts between the cylinder block and the cylinder head, the ducts 22, on the cooling liquid input/output side, having a cross-section less than those 24 on the side opposite thereto; this difference appears still more clearly in FIG. 8 and in FIG. 10 in which are shown the communication orifices 23 and 25 provided in the cylinder head facing ducts 22 and 24 of the cylinder block. This difference in cross-section forces circulation of a substantial portion of the cooling liquid in the annular chamber 34, prior to its passage into the circulation channels 36 of the cylinder head.

FIG. 7 also shows that the cylinder liners 28 having upper collars 30 and lower collars 31 on which are provided flats 32 and 33 enable blocking rotation of said liners.

Figure 8:
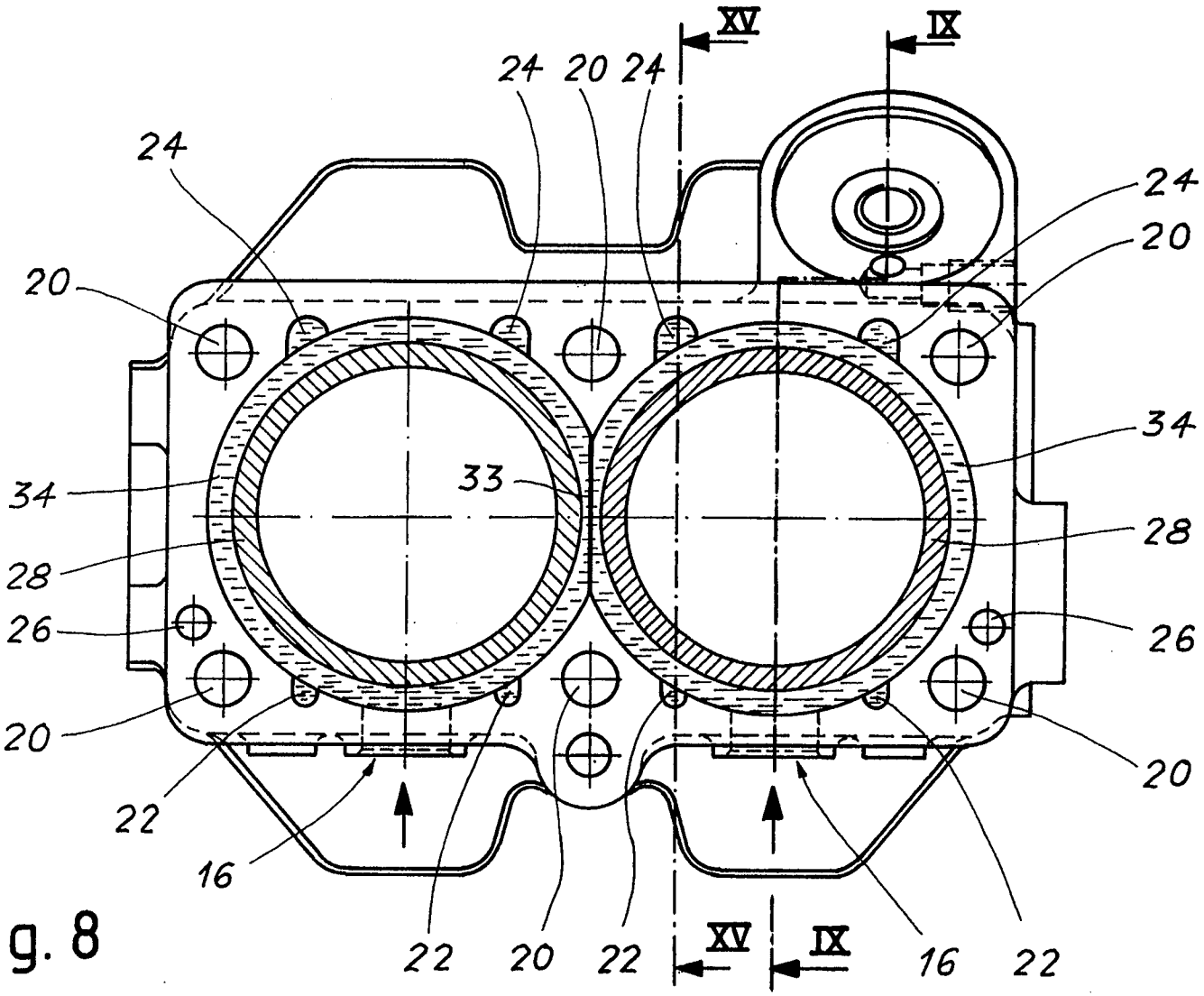
FIG. 8 shows a top view of the engine block according to line VIII—VIII of FIG. 6, the two cylinder liners having been cut off at the level of the collar.

Beside the elements already mentioned, FIGS. 8 and 9 enable understanding of the cooling liquid circulation in the cylinder block 1 from the inlet 16 up to ducts 22 and 24 communicating respectively with holes 23 and 25 of the cylinder head 2 shown on FIG. 10 as a view from below.

Figure 10:
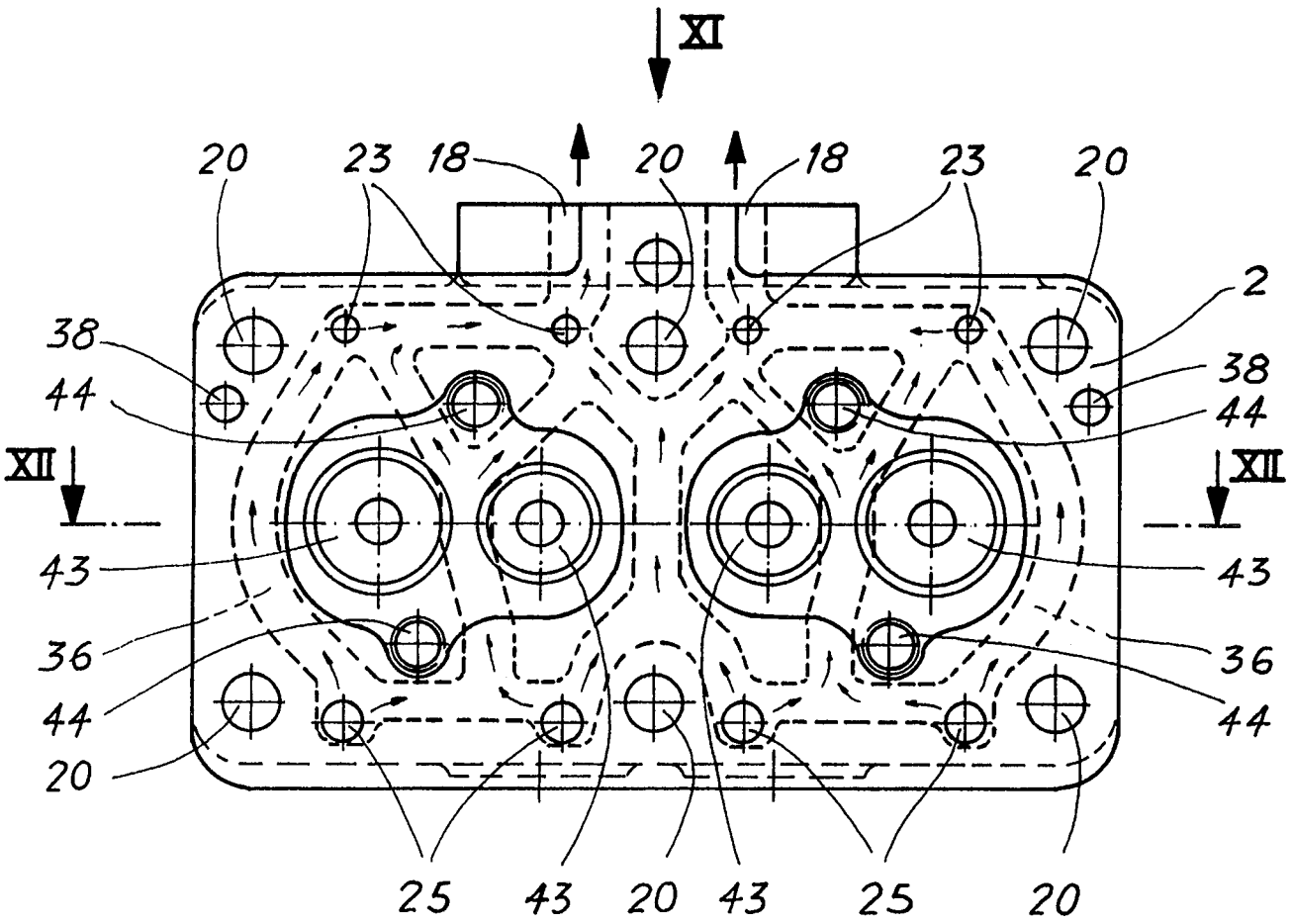
FIG. 10 shows a bottom view of the cylinder head according to line X—X of FIG. 6 or 11.

FIG. 10 also shows the cooling liquid circulation channels 36 between the different portions machined in the cylinder head for the valve seats 43 and the spark plug wells 44.

Figure 11:
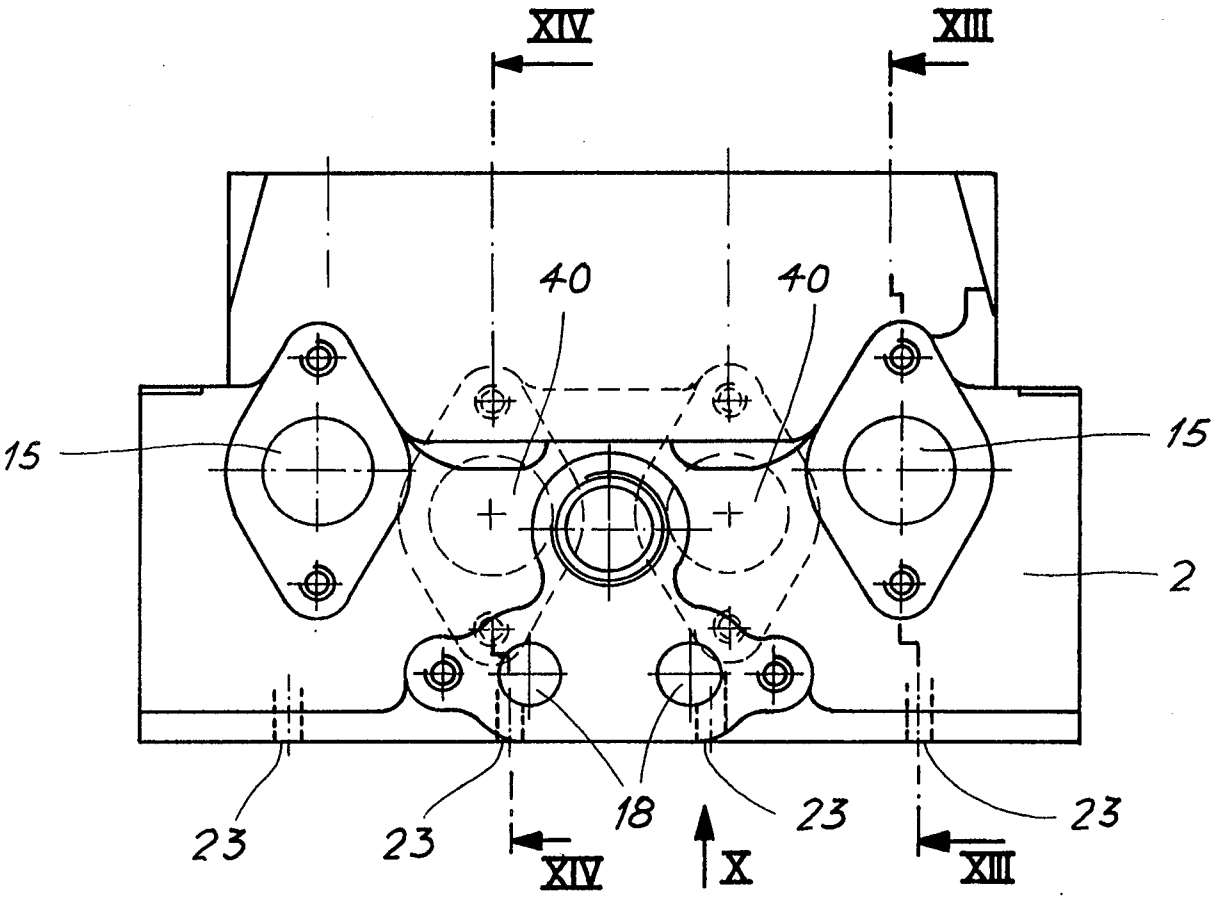
FIG. 11 shows a side view of the cylinder head according to arrow XI of FIG. 10.
Figure 12:
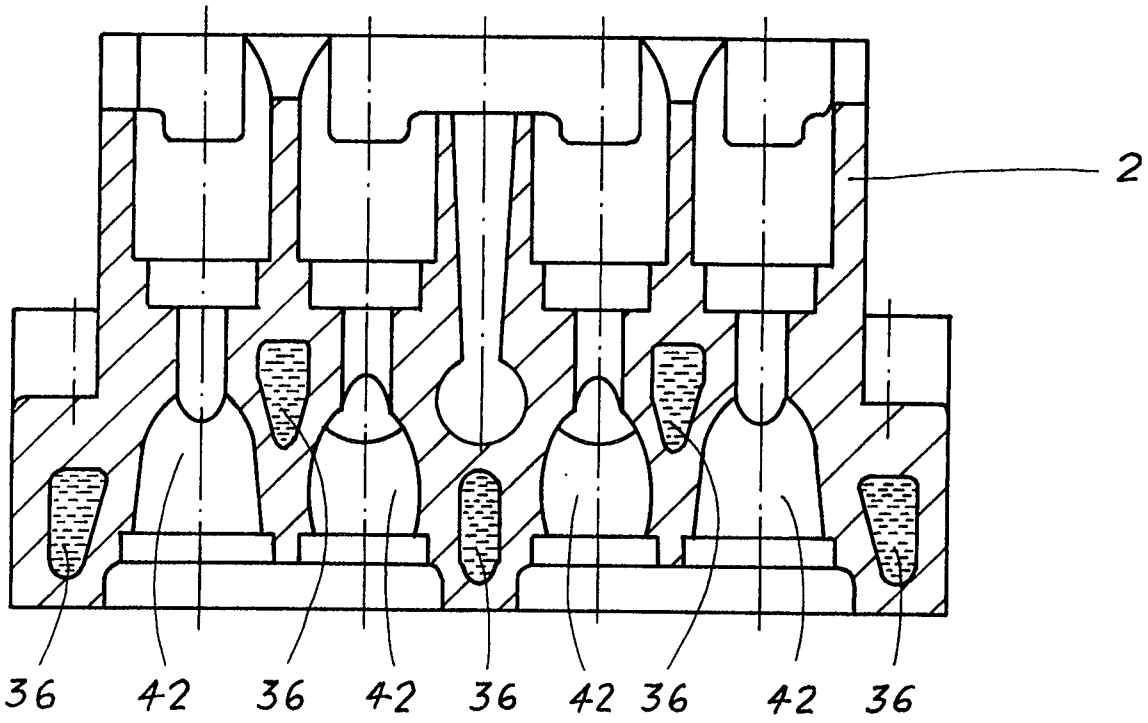
FIG. 12 shows a cross-section of the cylinder head of FIG. 10 along line XII—XII.
Figure 13:
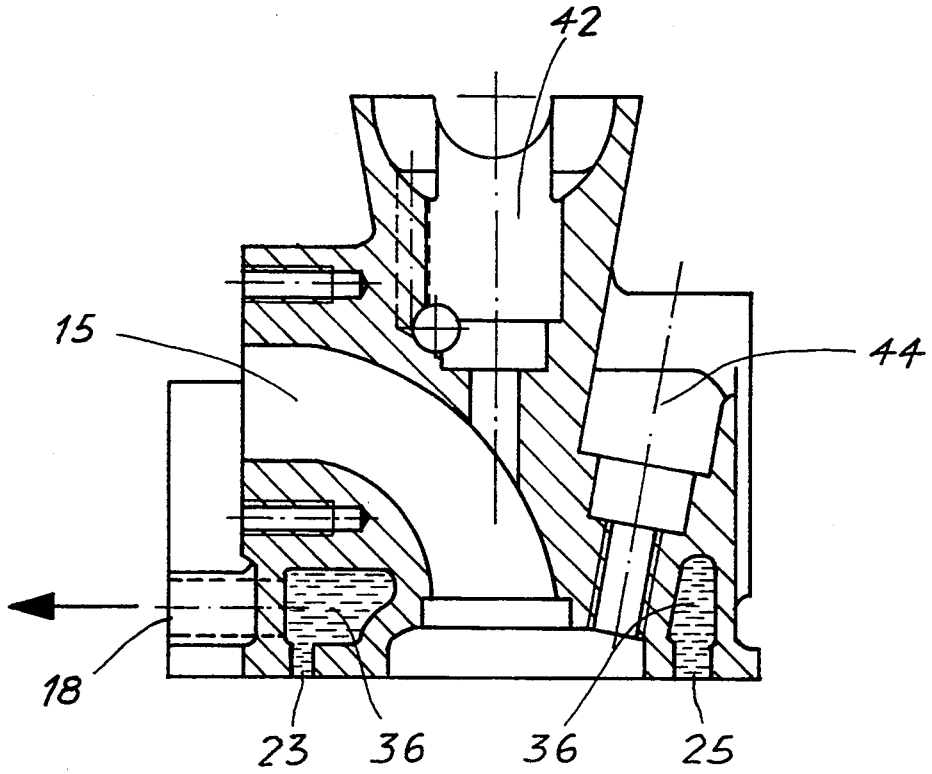
FIG. 13 shows a broken cross-section of figure along line XIII—XIII.
Figure 14:
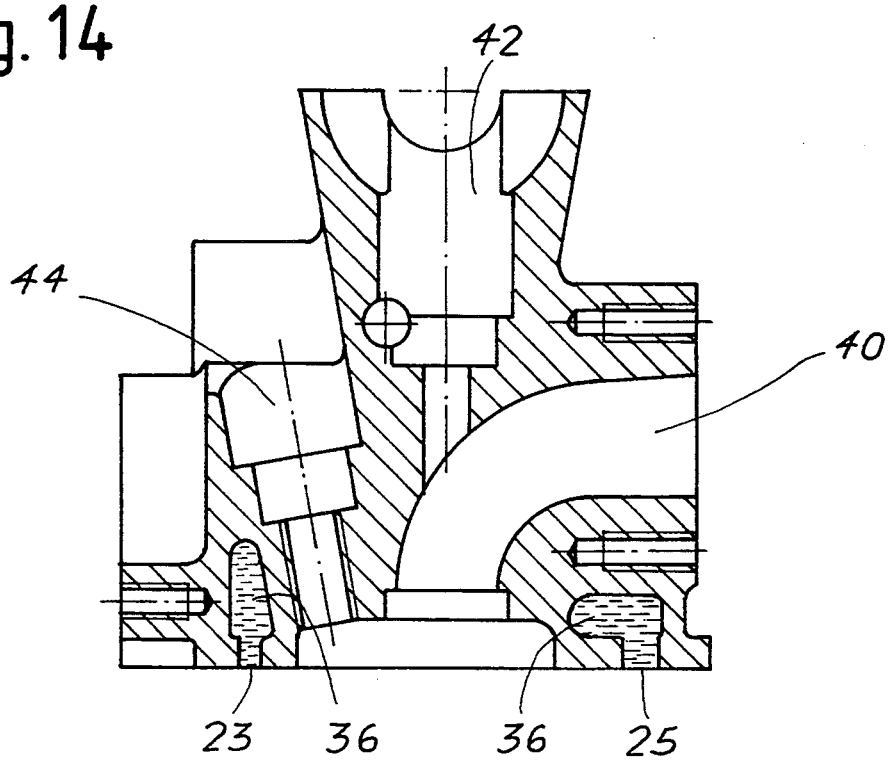
FIG. 14 shows a broken cross-section of figure along line XIV—XIV.

FIG. 11, which shows in dashed outline the exhaust gas orifices 40 on the side opposite to the outlet orifices 18 of the cooling liquid, enables better understanding of the cross-section shown on FIGS. 13 and 14 which, completed by the cross-section of FIG. 12, illustrate the circulation of cooling liquid in the channels 36 of the cylinder head 2.

Figure 9:
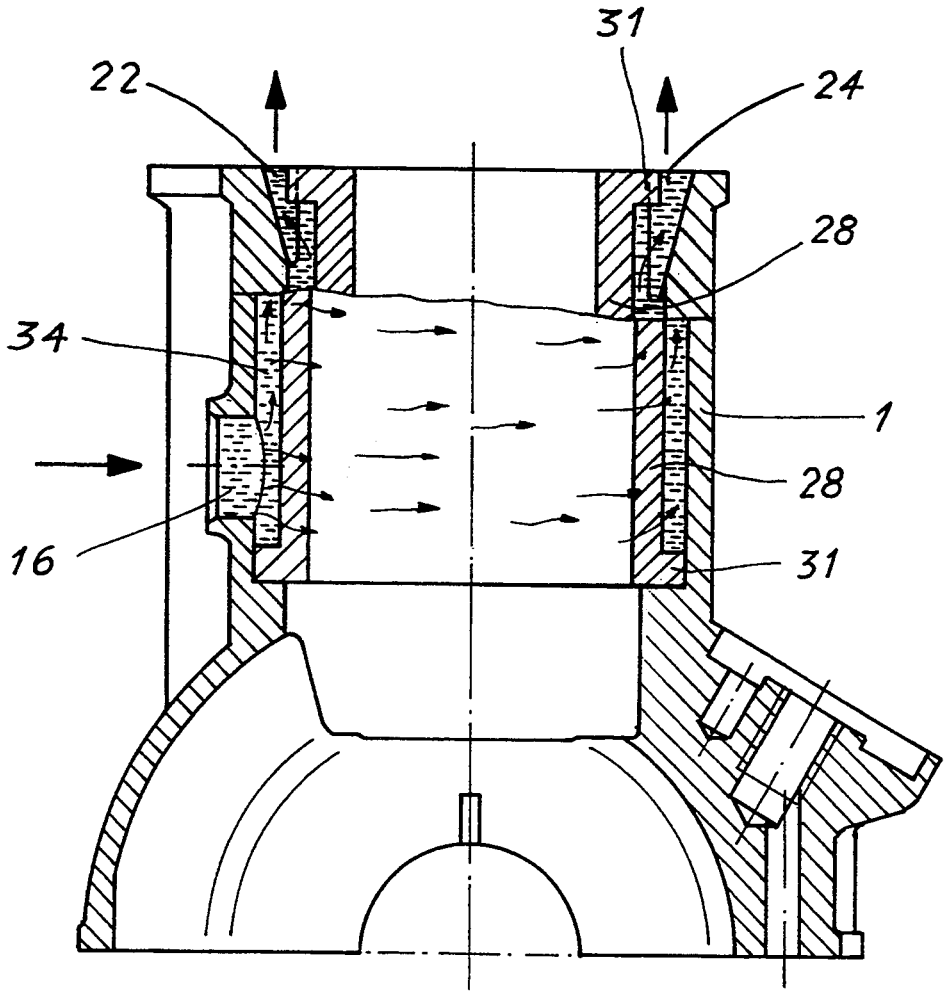
FIG. 9 shows a broken cross-section along line IX—IX of the cylinder block and the cylinder liner of figure in its lower portion and according to the line XV—XV in its upper portion.
Figure 15:
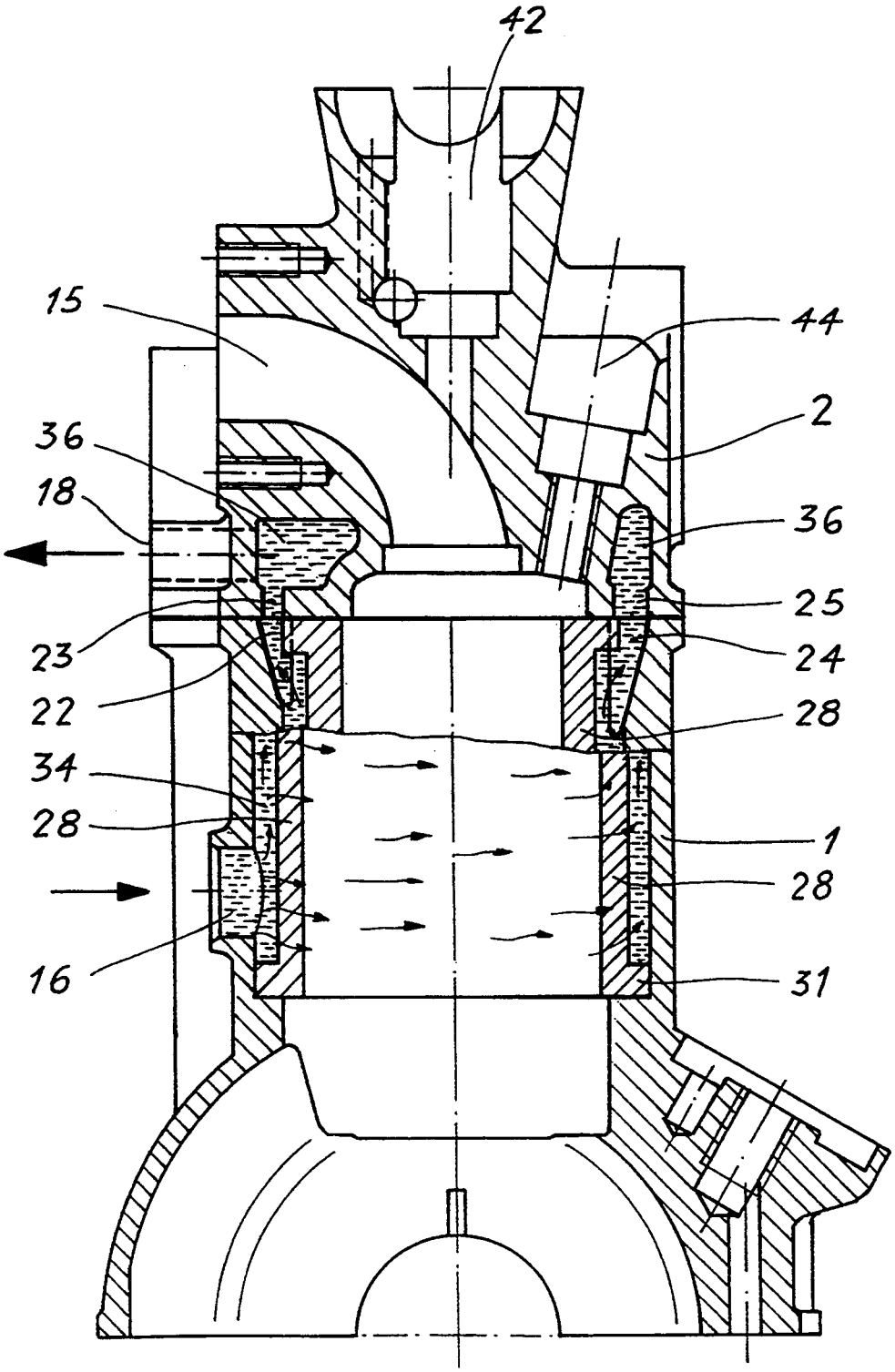
FIG. 15 shows, by assembling the cross-sections represented on FIGS. 9 and 13, the circulation of the cooling liquid in the cylinder block and the cylinder head.

Lastly, FIG. 15, constituted by assembling FIGS. 9 and 13, shows a synthesis of the detailed explanations given beforehand, in showing circulation of the cooling liquid in the cylinder block 1 and cylinder head 2 perpendicular to the alignment of the cylinders from the input orifice 16 through the annular chamber 34 of the cylinder liner 28, then the communications ducts 22–23 and 24–25 to pass finally into the circulation channels 36 up to the outlet orifice 18, located on the same face of the engine as inlet orifice 16, but having a lesser diameter.

In this detailed example the cooling liquid inlets and outlets are located at the side of the intake pipe for the fuel mixture; it is also possible whilst remaining within the framework of the invention, to provide engines having cooling liquid inlets and outlets on the side of the exhaust pipes. Similarly, remaining within the framework of the invention, it is possible to provide engines having more than two cylinders and/or a cubic capacity greater than 250 cc or indeed two-stroke engines or engines having a fuel other than gasoline.

The cooling system according to the invention enables in all cases an increase in efficiency and/or improvement in fuel consumption. According to a preferred embodiment, the previously-mentioned improvement as well as a reduction in the production of noxious products in the exhaust gases is obtained in having the engine turn under constant conditions.

Engines according to the invention operating as main or auxiliary engine, find their application in all types of appliances such as automotive vehicles and in the driving of all types of machines such as pumps or generators of electricity.

What we claim is:

1. A liquid cooled internal combustion engine having a cylinder block, a cylinder head and at least two cylinders, each having a cylinder liner, comprising a cooling circuit for the cylinder block and cylinder head for circulating cooling liquid in a path generally perpendicular to the cylinder alignment, said cooling circuit including:

an inlet and an outlet orifice;

an annular chamber surrounding each of said cylinders between the cylinder liner and the cylinder block;

means coupling said input orifice to said annular chambers;

circulation channels arranged in said cylinder head and extending to said outlet orifice; and ducts coupling each of said annular chambers to said circulation channels for circulating cooling liquid in said annular chambers and said channels in paths generally perpendicular to the axes of said cylinders; said annular chambers and said circulation channels of each of said cylinders having a substantially constant cross-sectional area, said outlet orifice being located on the same side of the engine as said inlet orifice.

2. An internal combustion engine as set forth in claim 1 wherein said outlet orifice has a cross sectional area less than that of said inlet orifice.

3. An internal combustion engine as set forth in claim 1 wherein, for each of said cylinders, said ducts include a duct having a relatively smaller cross sectional area located on the side of the cylinder proximate the same side of the engine as said inlet orifice, and a duct having a relatively larger cross sectional area located proximate the opposite side of said cylinder.

4. An internal combustion engine as set forth in claim 1 further including means directly connecting the annular chambers of each cylinder with one another.

5. An internal combustion engine as set forth in claim 1 wherein each cylinder liner includes an upper collar and a lower collar extending radially outward, each collar including a flat which, with the corresponding flat of the neighboring liner, blocks rotation of the liner.

* * * * *